US010583970B2

(12) United States Patent
Castro et al.

(10) Patent No.: US 10,583,970 B2
(45) Date of Patent: Mar. 10, 2020

(54) CHILDPROOF STORAGE BOX

(71) Applicants: Eileen Fernandez Castro, Canyon Country, CA (US); Robert Cabotaje Castro, Canyon Country, CA (US)

(72) Inventors: Eileen Fernandez Castro, Canyon Country, CA (US); Robert Cabotaje Castro, Canyon Country, CA (US)

( * ) Notice: Subject to any disclaimer, the term of this patent is extended or adjusted under 35 U.S.C. 154(b) by 198 days.

(21) Appl. No.: 15/731,926

(22) Filed: Aug. 24, 2017

(65) Prior Publication Data

US 2019/0062014 A1 Feb. 28, 2019

(51) Int. Cl.

| | |
|---|---|
| ***B65D 55/02*** | (2006.01) |
| ***B65D 6/06*** | (2006.01) |
| ***A24F 23/00*** | (2006.01) |
| ***B65D 50/06*** | (2006.01) |
| ***B65D 81/20*** | (2006.01) |
| ***B65D 83/00*** | (2006.01) |

(52) U.S. Cl.

CPC ..... *B65D 55/02* (2013.01); *A24F 23/00* (2013.01); *B65D 11/12* (2013.01); *B65D 50/06* (2013.01); *B65D 81/2023* (2013.01); *B65D 83/00* (2013.01); *B65D 2215/00* (2013.01)

(58) Field of Classification Search

CPC ..... B65D 55/02; B65D 11/12; B65D 50/06; B65D 81/2023; B65D 83/00; B65D 2215/00; A24F 23/02

USPC ..... 206/1.5, 242–276, 216, 223

See application file for complete search history.

(56) References Cited

U.S. PATENT DOCUMENTS

| | | | | | |
|---|---|---|---|---|---|
| 976,165 | A * | 11/1910 | Gray | B65D 50/045 | 206/1.5 |
| 3,258,017 | A * | 6/1966 | Albert | A45C 5/005 | 132/315 |
| 3,532,075 | A * | 10/1970 | Cooper | A01K 5/0291 | 119/51.12 |
| 4,593,813 | A * | 6/1986 | Powel | H05K 13/0069 | 206/453 |
| 4,932,547 | A * | 6/1990 | Rodriguez | A45C 11/24 | 206/1.5 |
| 5,782,359 | A * | 7/1998 | McAllister | B65D 41/06 | 206/1.5 |
| 5,826,715 | A * | 10/1998 | Thompson | A24F 15/005 | 206/261 |
| 6,561,348 | B2 * | 5/2003 | Kuo | A45C 13/126 | 206/315.1 |
| 7,156,226 | B1 * | 1/2007 | Van Sickle | A45C 11/20 | 206/1.5 |

(Continued)

*Primary Examiner* — Chun Hoi Cheung

(57) ABSTRACT

A childproof storage box with an open-ended box shaped housing which holds a first drawer, a tray member and a bag member. The open-ended box can be closed with a first hinged lid that doses the open end and a second hinged lid that folds over the top of the open-ended box. A male locking member is attached to the top of the open-ended box. An aperture in the second hinged member allows it to go over the male locking member and be held in place by the female locking member. The tray fits into the first drawer and the bag fits within the tray. The bag can hold botanical materials and the drawer can hold accessories that are used when smoking botanical materials. The bag may be a vacuum type bag and a vacuum pump may be included within the box.

5 Claims, 3 Drawing Sheets

(56) References Cited

U.S. PATENT DOCUMENTS

| | | | | |
|---|---|---|---|---|
| 7,367,450 | B2 * | 5/2008 | Maglione | A45C 5/04 206/223 |
| 8,322,566 | B2 * | 12/2012 | Hackett | B65D 7/16 206/1.5 |
| 8,833,115 | B2 * | 9/2014 | Nakasuji | E05B 73/0023 206/1.5 |
| 2003/0057110 | A1 * | 3/2003 | Montgomery | B44D 3/02 206/1.7 |
| 2003/0136705 | A1 * | 7/2003 | Roth | A24C 1/00 206/582 |
| 2006/0070901 | A1 * | 4/2006 | Adams | B25H 3/00 206/373 |
| 2006/0207894 | A1 * | 9/2006 | Maglione | A45C 5/04 206/223 |
| 2008/0210577 | A1 * | 9/2008 | Van Handel | A47G 29/10 206/1.5 |
| 2015/0375918 | A1 * | 12/2015 | Holderness | B67D 3/0067 222/566 |
| 2016/0194127 | A1 * | 7/2016 | Lahey | G08B 13/126 206/317 |

* cited by examiner

CHILDPROOF STORAGE BOX

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of storage boxes and more specifically to childproof storage box for holding botanical materials.

Storage boxes of all shapes and sizes are well known. One need for storage capability is the storage of botanical materials and the associated accessories normally used when smoking botanical materials.

Botanical materials may be dangerous if placed in the hands of young children. There is therefore, a need to create a storage container that is easy to open for adults but is difficult to open for young children. Additionally, some botanical materials produce a strong odor. Therefore, is would be ideal for a storage box for botanical materials to include an odor absorbing material. Finally, it would be ideal for the air within the botanical storage area to be evacuated thereby elongating the useful life of the botanical material stored inside. Several manufacturers now offer a botanical storage bag that is lockable with a small key.

However, there is a deficiency in the current lockable bags in that the key may be lost. Additionally, there is no provision to evacuate the air from the bag, thereby shortening the effective useful life of the botanical material. Additionally, there is no organized method of storing accessories associated with the smoking of botanical materials. Finally, there is no effective method for trapping odor emanating from the botanical materials stored inside the bag or box.

BRIEF SUMMARY OF THE INVENTION

The primary object of the invention is to provide a childproof storage box that allows adults to access contents but not young children.

Another object of the invention is to provide a childproof storage box that stores botanical materials as well as items associated with smoking botanical materials.

Another object of the invention is to provide a childproof storage box that stores a vacuum sealed pouch and a hand operated vacuum pump for use when resealing the pouch.

A further object of the invention is to provide a childproof storage box that includes odor absorbing material that limits the transmission of odors from botanical materials stored inside the box.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a childproof storage box comprising:

an open ended box shaped housing, a first drawer, a tray member, a bag member, a male locking member, a female locking member, said male locking member fixedly attached to the top surface of said box shaped housing, said box shaped housing including a hinged lid, said lid including a first hinged member capable of enclosing the open end of said main box shaped housing, said second hinged member capable of overlapping said top surface of said open ended box shaped housing, said second hinged member including an aperture that aligns with and overlays said male locking member, said female locking member capable of engaging said male locking member causing the contents of said box shaped housing to be inaccessible to a young child or pet, said first drawer slidably engaged with the inside of said open ended box shaped housing, said tray member capable of being inserted into said first drawer, and said bag member capable of being inserted into said tray.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
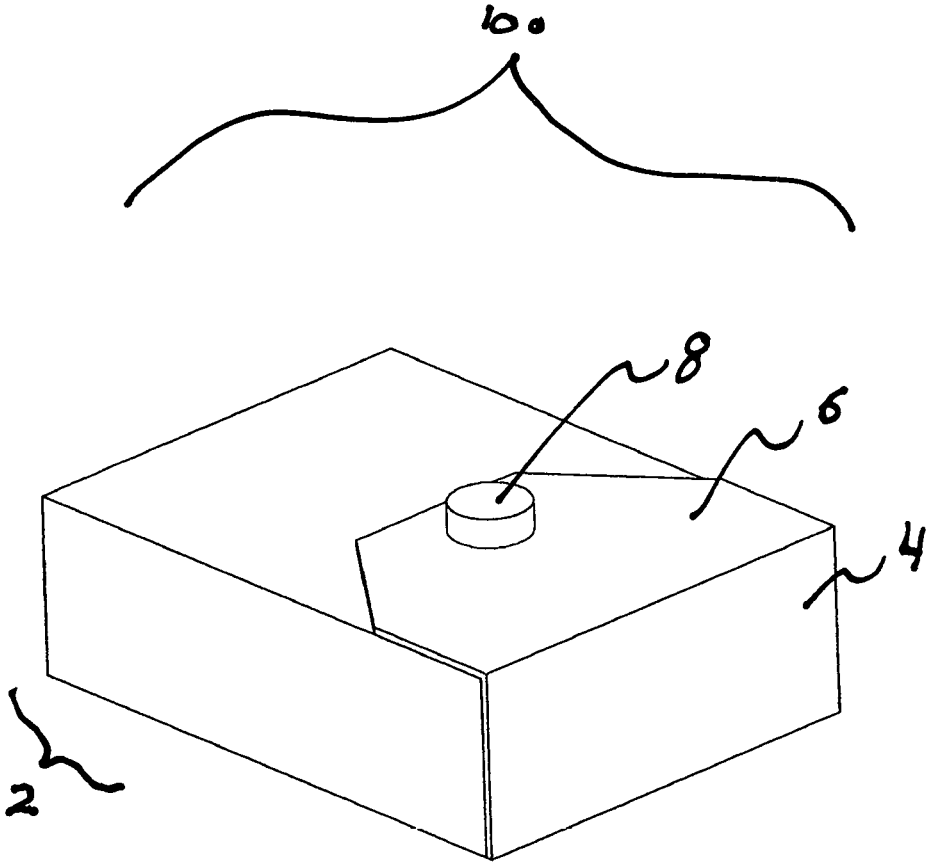
FIG. 1 is a perspective view of the invention.

Referring now to FIG. 1 we see a perspective view of the lockable storage box 100 of the present invention. The main box 2 is open ended. The open end is covered with first hinged lid member 4. A second hinged member 6 overlaps the top of the box 2. A childproof locking cap 8 must be removed to access the contents of the box 2.

Figure 2:
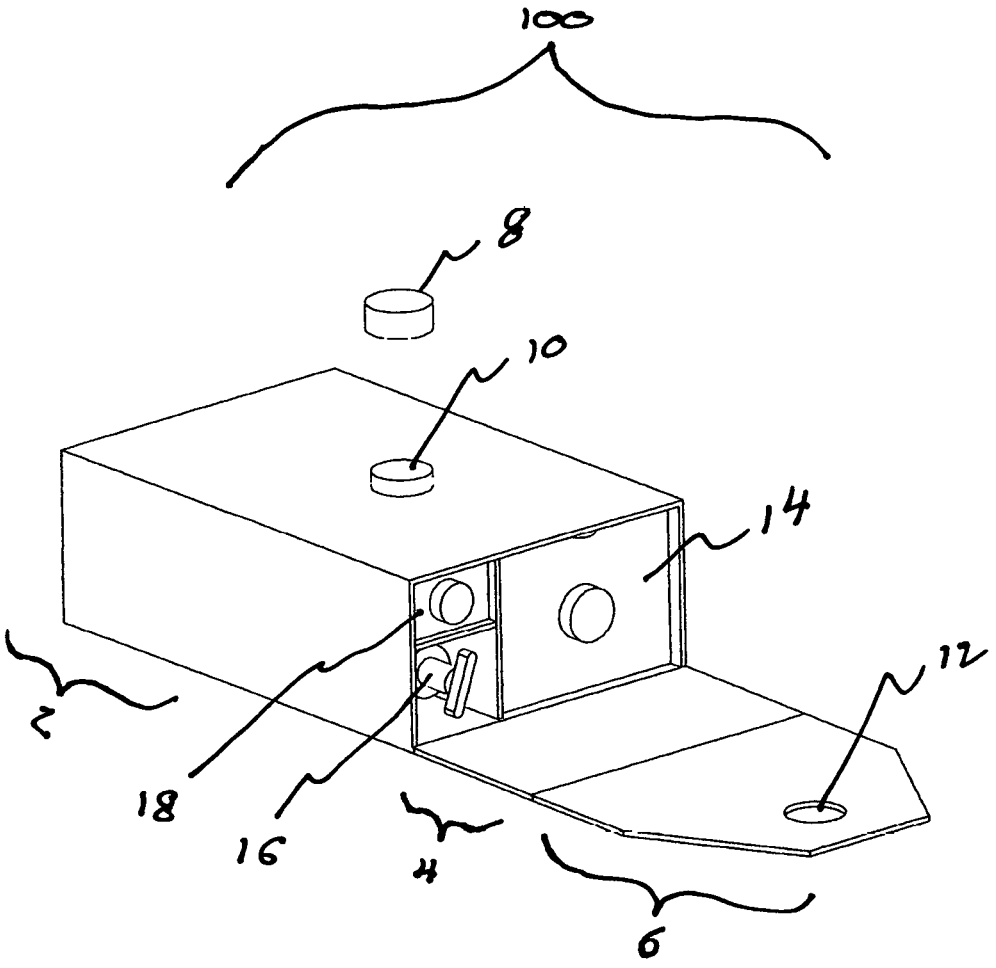
FIG. 2 is a perspective view of the invention with the hinged lid in the open position.

FIG. 2 shows a perspective view of the box 2 in the open position with first and second hinge members 4, 6 laid flat. An aperture 12 in the second hinged lid 6 aligns with the male portion 10 of the locking member so that when the second hinged member 6 lays on top of the box 2, the male locking member protrudes through the aperture 12, allowing female locking member 8 to be attached to the male locking member 10. The locking mechanism is similar to that found on Advil bottles which requires the user to press in on the sides of the cap 8 before it will release from the male locking member 10. This double action is beyond the ability of young children and therefore prevents them from opening the box 100 and accessing the contents within. This technology is now in the public domain. Spaces are allocated with in the box 2 for a first drawer 14, a second drawer 18 and a vacuum pump 16.

Figure 3:
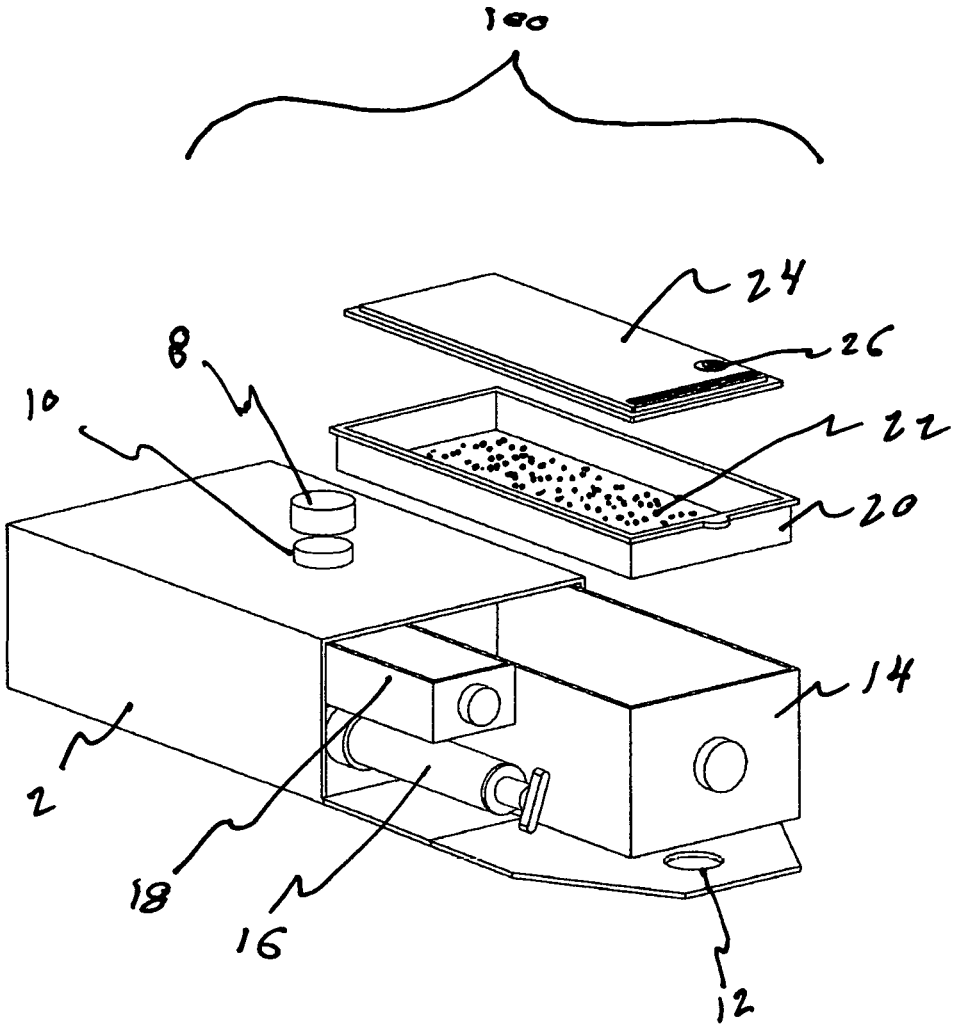
FIG. 3 is an exploded view of the invention

FIG. 3 is an exploded view of the invention 100. The first drawer 14 has been partially pulled out. Tray 20 is capable of resting in the drawer 14 with the lip of the tray 20 resting on the top edge of the drawer 14. The tray 20 includes a foam panel 22 that has been infused with activated charcoal. Which acts as an odor absorber for the contents of the box 2. A flexible, re-sealable bag 24 is sized to fit within the tray 20. The bag 24 is meant to store botanical materials. In the preferred embodiment, the bag 24 includes a vacuum valve 26 that lets the user evacuate excess air within the bag 24 via vacuum pump 16 thereby increasing the useful life of the botanical materials stored within the bag 24. Second drawer 18 can be used to store accessories associated with smoking botanical materials.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A childproof storage box comprising:

an open-ended box shaped housing;

a first drawer;

a tray member;

a bag member;

a male looking member;

a female locking member;

said male locking member fixedly attached to a top surface of said open-ended box shaped housing;

said open-ended box shaped housing including a hinged lid with a first and second hinged member;

said first hinged member capable of closing an opening of said open-ended box shaped housing;

said second hinged member capable of overlapping said top surface of said open-ended box shaped housing;

said second hinged member including an aperture that aligns with and overlays said male locking member;

said female locking member capable of engaging said male locking member causing the contents such as botanical related accessories of said open-ended box shaped housing to be inaccessible to a young child or pet;

said first drawer slidably engaged with an inside of said open-ended box shaped housing;

said tray member capable of being inserted into said first drawer and said bag member capable of being inserted into said tray member.

2. The childproof storage box as claimed in claim 1, further comprising a second drawer member capable of sliding into said open-ended box shaped housing and sitting adjacent to said first drawer member; said second drawer member capable of retaining accessories associated with the use of botanical materials.

3. The childproof storage box as claimed in claim 1, wherein said bag member is re-sealable and capable of retaining a vacuum.

4. The childproof storage box as claimed in claim 1, further comprising a vacuum pump stored within said storage box.

5. The childproof storage box as claimed in claim 1, further comprising an odor absorbing panel that helps trap odors from botanical materials to remain in said storage box.

* * * * *